US005278807A

United States Patent [19]

Mathys

[11] Patent Number: 5,278,807

[45] Date of Patent: Jan. 11, 1994

[54] EXTRA-THIN WATCH MOVEMENT

[75] Inventor: Pierre Mathys, La Chaux-de-Fonds, Switzerland

[73] Assignee: Frederic Piguet S.A., Le Brassus, Switzerland

[21] Appl. No.: 67,070

[22] Filed: May 26, 1993

[30] Foreign Application Priority Data

Jun. 6, 1992 [CH] Switzerland ..... 01 818/92-0

[51] Int. Cl.[5] ..... G04B 1/10; G04B 23/00

[52] U.S. Cl. ..... 368/140; 368/147; 368/206; 368/220

[58] Field of Search ..... 368/139, 368/147, 151, 206, 368/208, 220, 368/324

[56] References Cited

U.S. PATENT DOCUMENTS

| | | | |
|---|---|---|---|
| 3,852,954 | 12/1974 | Bachmann | 58/59 |
| 3,952,498 | 4/1976 | Saito et al. | 58/82 A |
| 4,117,664 | 10/1978 | Mathys | 58/86 |
| 4,132,061 | 1/1979 | Mathys | 58/59 |
| 4,363,553 | 12/1982 | Thomi et al. | 368/140 |
| 5,119,348 | 6/1992 | Mathys | 368/151 |

FOREIGN PATENT DOCUMENTS

| | | |
|---|---|---|
| 341577 | 6/1904 | France . |
| 375289 | 3/1964 | Switzerland . |
| 610178 | 4/1979 | Switzerland . |

*Primary Examiner*—Vit W. Miska

*Attorney, Agent, or Firm*—Griffin, Butler, Whisenhunt & Kurtossy

[57] ABSTRACT

A manually or automatically wound extra-thin watch movement, comprising at least one barrel (3) and in which all the wheel sets are assembled in cantilever on one sole base plate (1) with the help of one ball bearing only (15 to 21). The ratchet (25) is in the form of a drum surrounding the barrel. It is swivelled by its periphery with the help of at least three rollers, each pivoted on a ball bearing, and the barrel (3) is pivoted within the ratchet by means of a ball bearing (23). This design enables reducing to a minimum the energy losses due to friction.

4 Claims, 2 Drawing Sheets

EXTRA-THIN WATCH MOVEMENT

The present invention has as object an extra-thin watch movement with manual or automatic winding comprising at least one barrel and in which all the wheel sets are assembled in cantilever on a sole base plate with the help of one ball bearing only.

BACKGROUND OF THE INVENTION

The utilization of miniature ball bearings has enabled pivoting the wheel sets of a movement in cantilever on a sole base plate and thus designing extra-thin movements the thickness of which in their manual winding version does not exceed 1.5 mm. Such a design is described in Pat. No. CH 610 178. In this movement, the barrel is swivelled in the thickness of the movement by its periphery with the help of three rollers, each pivoted on a miniature ball bearing and the ratchet is pivoted on the spindle of the barrel. It has been sought to further reduce the thickness of the movement. Such a reduction is inevitably accompanied by a diminishing of the width of the motor spring housed in the barrel, that is to say, a diminishing of the available energy when the spring is wound, that is to say, a diminishing of the running time reserve of the watch. It is certainly possible to compensate such reduction of energy by using two barrels as is taught in Swiss Pat. No. CH 375 289, but with such small dimensions of the motor spring the significance of friction and energy losses resulting therefrom increases.

Now if one considers the conception of the barrel according to the prior art, it is noted that the barrel is subjected to two opposing twisting moments, one due to the spring and the other to the ratchet. Such twisting moments are not in the same plane, this having inevitably as effect to cause twisting in a plane perpendicular or oblique to the plane of the movement base plate because of the cantilever. The drum of the barrel nevertheless cannot be freely displaced relative to its ideal axis because of the rollers which surround it, this causing friction which is practically impossible to eliminate in such a swivelling arrangement.

The present invention has as purpose to eliminate such friction.

SUMMARY OF THE INVENTION

The watch movement according to the invention is characterized in that the ratchet is in the form of a drum surrounding the barrel drum and swivelled by its periphery with the help of at least three rollers, each pivoted on a ball bearing and in that the barrel is pivoted in the ratchet.

This design which departs entirely from the conventional design of the barrel enables eliminating friction as mentioned hereinbefore since the drum of the barrel is free to be displaced under the effect of the twisting moment described hereinbefore.

The ratchet being only a stationary passive element, the friction which it may encounter at the level of its swivelling rollers plays only a secondary role. Thanks to the ball bearings, it is however very small and negligible in the case of an automatic arrangement using an oscillating mass.

In a manner to maintain the friction as low as possible, the barrel is preferably pivoted in the ratchet by means of a ball bearing mounted in a hub of the ratchet.

The attached drawings show by way of example an embodiment of the watch movement according to the invention.

DESCRIPTION OF THE PREFERRED EMBODIMENT

Figure 1:
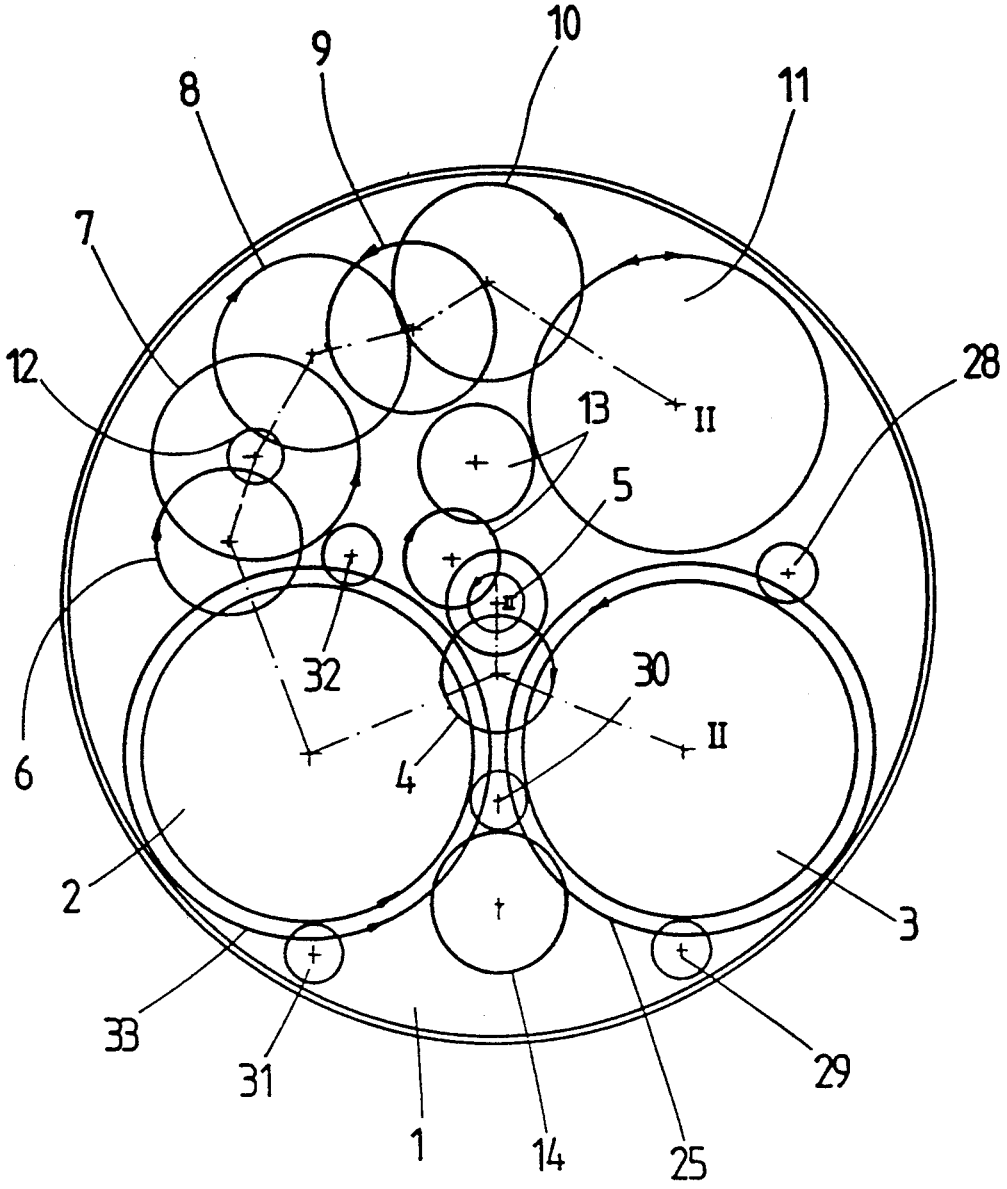
FIG. 1 shows a schematic plan view thereof.

The movement comprises two identical barrels 2 and 3 rotating in a sense contrary to one another and engaging a common intermediate wheel 4 meshing with the center pinion 5 on and in a single base plate 1. Barrel 2 is associated with a wheel train comprising successively a pinion 6, the center wheel 7, the third wheel 8, the seconds wheel 9 and the escape wheel 10 to end up at balance wheel 11. The pinion 6 meshes with pinion 12 of the center wheel 7. There may be further noted the dial train 13 and the wheel set 14 of the wheel train used for manual winding.

All the wheel sets are assembled in cantilever on the base plate by means of miniature ball bearings 15, 16, 17, 18, 19, 20, 21 as shown in greater detail in Swiss Pat. No. CH 610 178.

The two barrels are formed in an identical manner and it will be sufficient to describe the forming of barrel 3. The drum of barrel 3 is provided with a spindle 22 driven into the inner race of a ball bearing 23, the outer race of which is driven into the hub 24 of a ratchet 25 in the form of a drum, that is to say, provided with a crown 26 surrounding the barrel drum. Ratchet 25 exhibits on its exterior a peripheral groove 27 in which are engaged the edges of rollers pivoted on the base plate by means of a ball bearing and assuring swivelling of ratchet 25 by its periphery. Such rollers are shown in detail in Swiss Pat. No. 610 178. They are schematically shown in FIG. 1 at 28, 29, 30, 31, 32. Each of ratchets 25 and 33 is thus swivelled by means of three rollers, roller 30 being common to both ratchets.

The hub 24 of the ratchet thus constitutes the core of the barrel and it is provided with a hook 34 for the barrel spring. The drums of barrels 2 and 3 are thus solely pivoted by their center in a ball bearing reducing to a minimum the friction losses.

Figure 2:
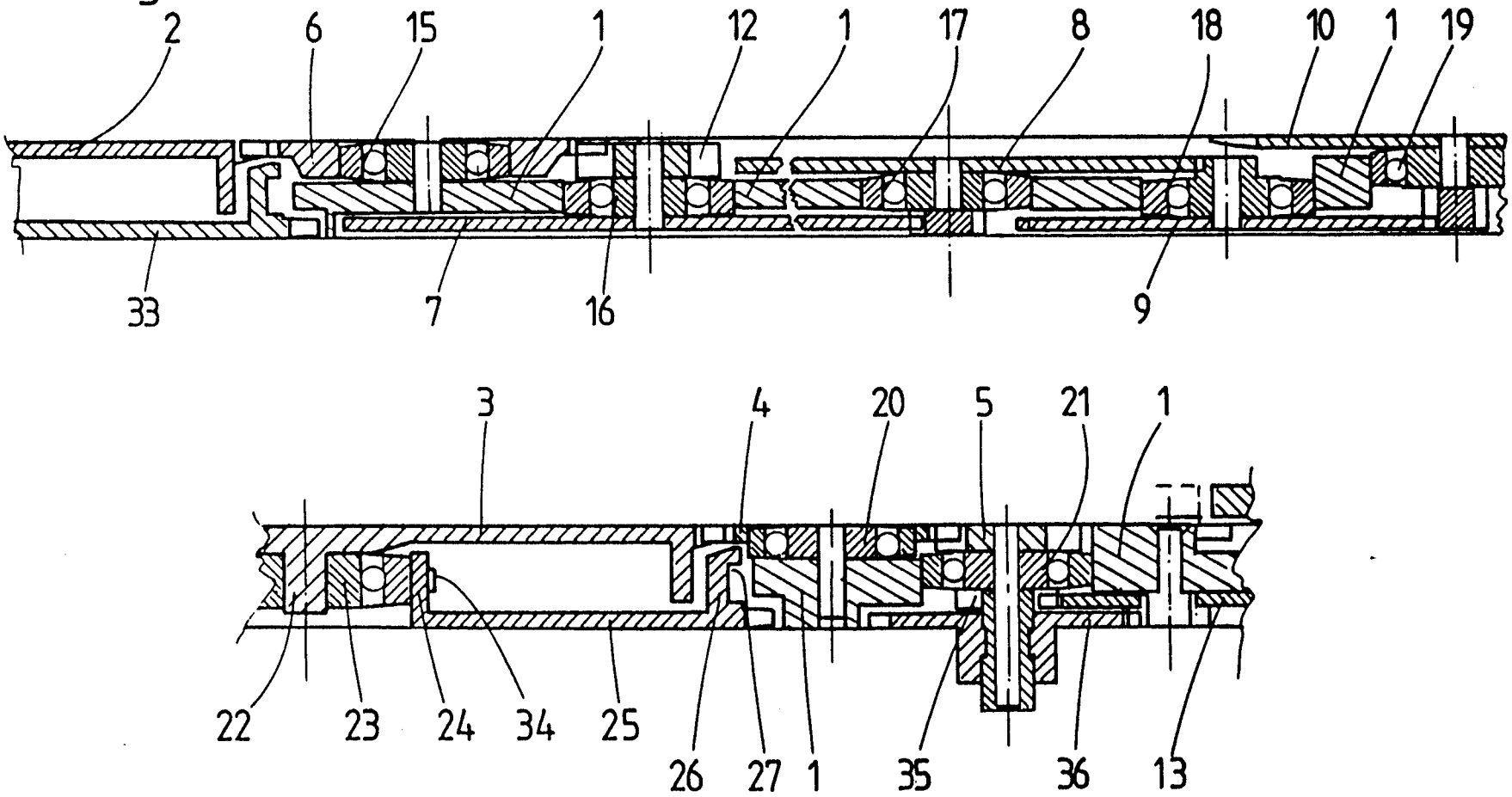
FIG. 2 shows a cross-section along line II—II of FIG. 1.

On FIG. 2 there will be further recognized the cannon pinion 35 and cannon wheel 36.

The new conception of barrels is, as is well understood, applicable to a movement including only a single barrel.

The movement described could be provided with an oscillating mass in order to obtain a movement with automatic winding.

What I claim is:

1. An extra-thin watch movement with manual or automatic winding comprising at least one barrel and in which all the wheel sets are assembled in cantilever on one sole base plate with the help of one ball bearing only, a ratchet being in the form of a drum surrounding the barrel and swivelled by its periphery with the help of at least three rollers, each pivoted on a ball bearing, the barrel being pivoted within the ratchet.

2. A watch movement as set forth in claim 1 wherein the ratchet exhibits a hub within which the barrel is pivoted by means of a ball bearing.

3. A watch movement as set forth in claim 1 comprising two barrels the ratchets of which are swivelled by five rollers, one of which is common to both ratchets.

4. A watch movement as set forth in claim 2 comprising two barrels the ratchets of which are swivelled by five rollers, one of which is common to both ratchets.

* * * * *